US005261529A

United States Patent [19]

Holland

[11] Patent Number: 5,261,529

[45] Date of Patent: Nov. 16, 1993

[54] EARRING STORAGE AND DISPLAY APPARATUS AND METHOD

[76] Inventor: Joanne P. Holland, P.O. Box 21086, St. Petersburg, Fla. 33742-1086

[21] Appl. No.: 911,481

[22] Filed: Jul. 10, 1992

[51] Int. Cl.[5] ..... A47F 7/02

[52] U.S. Cl. ..... 206/6.1; 53/449; 53/473; 206/486; 206/495; 211/113

[58] Field of Search ..... 53/449, 473; 206/6.1, 206/486, 488, 489, 566, 495; 211/13, 96, 113, 115, 116; 312/245

[56] References Cited

U.S. PATENT DOCUMENTS

| | | | |
|---|---|---|---|
| 2,162,919 | 6/1939 | McAuliffe et al. | 211/96 |
| 4,273,394 | 6/1981 | Chandler | 211/96 |
| 4,396,121 | 8/1983 | Lemmon | 206/566 |
| 4,606,458 | 8/1986 | LaBate | 206/566 |
| 4,687,103 | 8/1987 | Corbett | 206/495 |
| 4,720,012 | 1/1988 | Dufour | 206/495 |
| 4,760,920 | 8/1988 | Thomsen | 206/495 |
| 4,767,011 | 8/1988 | Butler | 211/13 |
| 4,811,996 | 3/1989 | Hansson | 312/132 |
| 4,821,883 | 4/1989 | Miller | 206/495 |
| 4,905,821 | 3/1990 | Corbett | 206/45.24 |
| 4,958,727 | 9/1990 | Bergeron | 206/6.1 |
| 5,025,918 | 6/1991 | Bergeron | 206/45.14 |
| 5,050,745 | 9/1991 | Sanders | 206/495 |
| 5,071,000 | 12/1991 | Stewart | 206/45.14 |
| 5,117,971 | 6/1992 | Fisher | 206/6.1 |
| 5,121,833 | 6/1992 | Lindsay et al. | 206/6.1 |
| 5,141,113 | 8/1992 | Elliott | 206/495 |

FOREIGN PATENT DOCUMENTS

| | | | |
|---|---|---|---|
| 1249986 | 10/1971 | United Kingdom | 211/96 |

*Primary Examiner*—Jimmy G. Foster

*Attorney, Agent, or Firm*—Antonio R. Durando; Harry M. Weiss

[57] ABSTRACT

An earring storage apparatus consisting of a multiplicity of individual vertical panels that hang from retaining rods braced horizontally over the sides of an open container. Each panel consists of a fabric sheet having a top edge looped around a support rod, so that the panel can hang therefrom, and of a plastic net layer attached to the fabric. A panel may also feature horizontal or vertical straps or a fringe attached to the plastic net layer. Each mesh in the plastic layer provides a suitable support substrate for the prong of hook earrings, or most post-type earrings and tie tacks, while the straps and fringes can be used conveniently for clasp earrings, wire-type earrings, circular earrings, large hoop-style post earrings, cufflinks, tie clasps and other jewelry. The fabric sheet protects the front of the earrings in the panel immediately behind. Each panel is housed hanging vertically from the side walls of the open container in the same fashion as files are commonly hung in drawers for storage. The upper front side of the container is equipped with clips that permit a user to hang any panel removed from the interior of the container to provide stability for displaying the earrings attached to it while a selection is made and while jewelry is attached for storage.

18 Claims, 3 Drawing Sheets

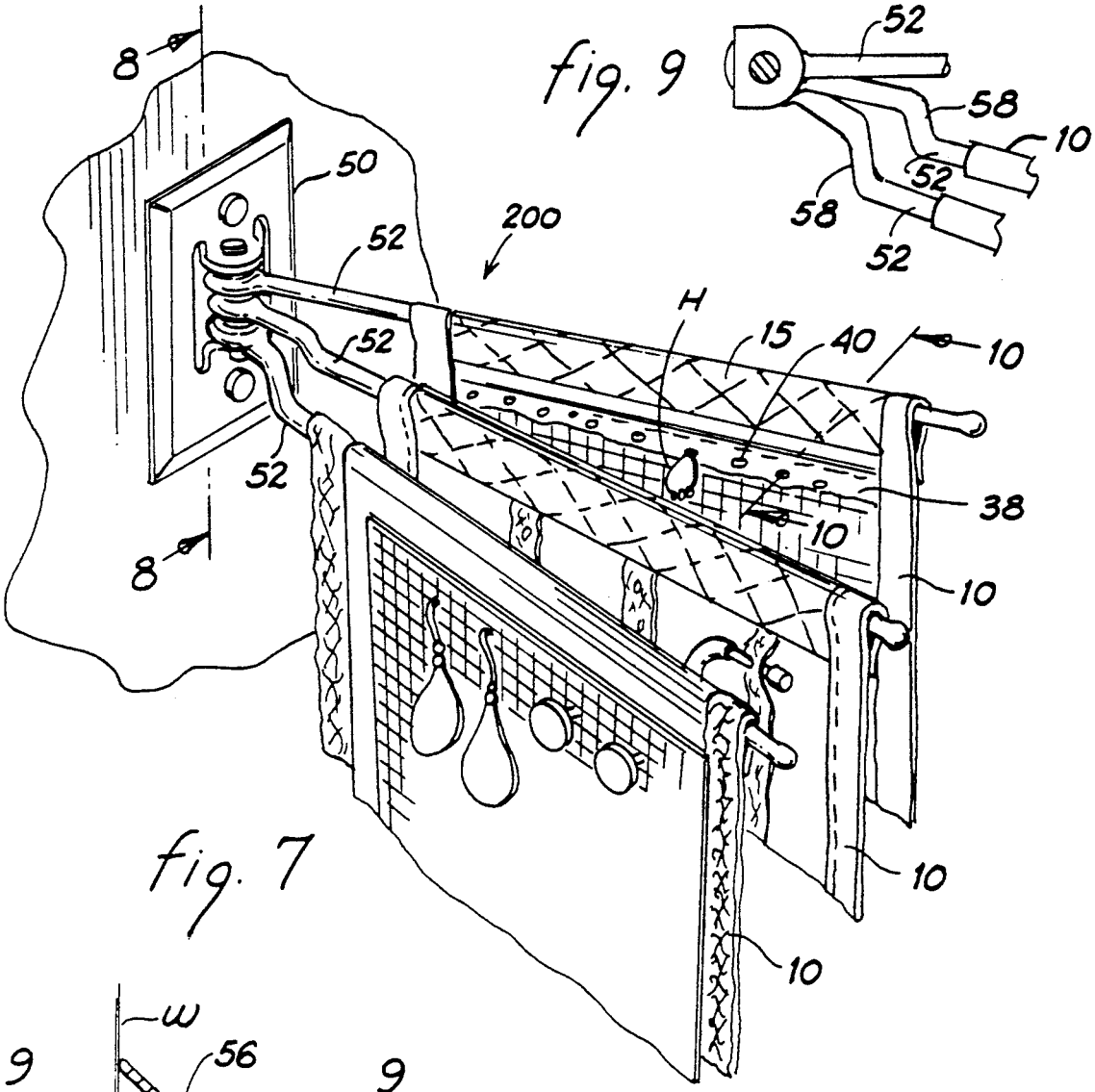
fig. 7
fig. 9
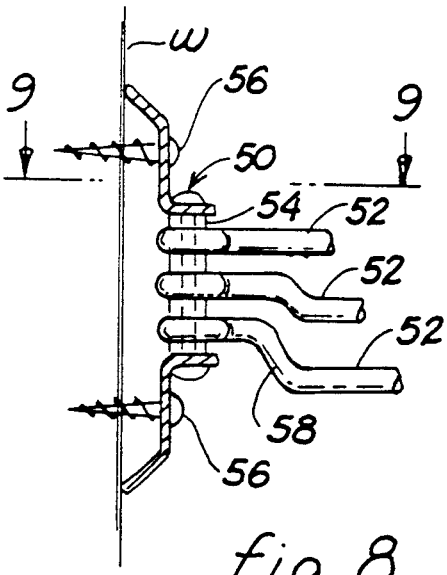
fig. 8
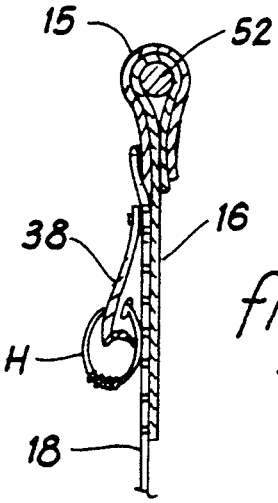
fig. 10

EARRING STORAGE AND DISPLAY APPARATUS AND METHOD

BACKGROUND OF THE INVENTION

1. Field of the Invention

This invention is related in general to the field of showcases and devices for storing and displaying jewelry. In particular, the invention provides a novel multiple-panel structure that permits the storage and display of easily accessible, independent sheets of vertically mounted pieces of jewelry, such as earrings, tie tacks, cufflinks, etc.

2. Description of the Prior Art

Jewelry is normally kept in special cases, which may also be adapted for ornamental or security purposes. Accordingly, a vast variety of cases and retaining devices have been manufactured over the years for the purpose of storing, protecting and displaying jewelry, including earrings. In particular, several prior art patents describe various types of earring holders.

For example, U.S. Pat. No. 4,396,121 to Lemmon (1983) discloses a jewelry display box having a completely transparent structure and including slidably mounted vertical plates for hanging the jewelry. The device provides a way for storing jewelry and yet keeping it visible for inspection without taking it out of the box.

In U.S. Pat. No. 4,606,458 (1986), LaBate describes a device for holding jewelry having a post for mounting on articles of clothing or pierced ears. The device consists of a fine-mesh cloth stretched over a frame, which provides a flat area through which the posts of the jewelry are inserted and held in place by the cloth.

In U.S. Pat. No. 4,767,011 (1988), Butler discloses a rectangular vertical frame with mesh material loosely stretched between its sides. The article is used as a support for earrings by hanging them on the threads constituting the mesh of the material.

U.S. Pat. No. 4,811,996 to Hansson (1989) illustrates a decorative case for earrings comprising a multiplicity of vertical frames slidably mounted in receiving slots in the walls of the case. Each frame encloses a mesh screen through which earrings may be hung on either side for display and storage. The case features a transparent front wall for viewing the jewelry and a lid with a mirror for seeing the earrings mounted on the back of the frames.

U.S. Pat. No. 4,821,883 to Miller (1989) discloses a foldable holder for post-equipped jewelry consisting of a sheet of cloth bonded to a layer of foam. The posts of the jewelry are inserted through the cloth and into the foam, which holds them in place, and the holder is folded into a roll that can be easily and conveniently stowed and transported.

In U.S. Pat. No. 4,905,821 (1990), Corbett teaches the use of a frame-mounted panel of woven material that provides a variable-position jewelry display device. As in the other prior art devices, the earring posts are inserted through the mesh of the material and, if so equipped, are kept in place by the clamp normally used for wearing.

U.S. Pat. Nos. 4,958,727 (1990) and No. 5,025,918 (1991) to Bergeron describe different embodiments of another foldable device for carrying and displaying post-type earrings. It consists of a showcase comprising a multilayered flexible frame to which the earrings are attached for display. The frame is folded in two forming a bag-like structure with a handle for convenience of transportation.

In U.S. Pat. No. 5,071,000 (1991), Stewart shows a collapsible frame for a woven cloth used to support earrings and other post-equipped jewels inserted therethrough. Two sides of the frame can be removed, leaving the other two sides as a scroll permitting the cloth to be rolled into a compact package.

Finally, U.S. Pat. No. 5,117,971 (1992) to Fisher describes another jewelry box having a completely transparent structure with vertically-mounted slide panels. The panels contain cut-out portions to enable a user to attach hoop earrings within the cut-out space, thus minimizing the dead space in the box.

It is clear that all these patents describe different features of portability, display, compactness, and versatility of use according to different objectives on the part of the inventors. This invention is aimed at producing a jewelry storage device that combines many of the advantages of the prior art in a single unit.

BRIEF SUMMARY OF THE INVENTION

One objective of this invention is an apparatus capable of storing large quantities of jewelry pinned in several compartments of a single retaining unit.

Another objective of the invention is an apparatus that permits the separation of like jewelry in different compartments for ease of categorization and retrieval.

Still another objective of the invention is a structure that makes it possible to view the various pieces of jewelry for selection without extracting them from their pinned position in the retaining compartment.

Another goal is a simple design for the apparatus, so that it may be manufactured economically utilizing simple components that are either already available in the open market or that can be produced at competitive prices.

In accordance with these and other objectives, one embodiment of this invention comprises a multiplicity of individual vertical panels hanging from retaining rods removably braced horizontally over the sides of an open container. Each panel consists of a fabric sheet having a top edge looped around a support rod, so that the panel can hang therefrom, and of a plastic net layer attached to the fabric. A panel may also feature horizontal or vertical straps or a fringe attached to the plastic net layer. Each mesh in the plastic layer provides a suitable support substrate for the prong of hook earrings and most post-style earrings, while the straps and fringes can be used conveniently for clip-on earrings, wire earrings, circular earrings, large hoops with posts, and cufflinks. Post earrings may be inserted either through the fabric sheet or a strap or fringe and kept in place by the friction nuts used for wearing them on ears. Each panel is housed hanging vertically from the side walls of the open container in the same fashion as files are commonly hung in drawers for storage. The upper front side of the container is equipped with clips that permit a user to hang any panel removed from the interior of the container for displaying the jewelry attached to it while a selection is made and for providing stability while the jewelry is being attached or detached from it.

Various other purposes and advantages of this invention will become clear from its description in the specification that follows, and from the novel features particularly pointed out in the appended claims. Therefore, to the accomplishment of the objectives described above, this invention consists of the features hereinafter illustrated in the drawings, fully described in the detailed description of the preferred embodiments and particularly pointed out in the claims. However, such drawings and description disclose only some of the various ways in which the invention may be practiced.

BRIEF DESCRIPTION OF THE DRAWINGS

FIG. 7 is a perspective view of a second embodiment of the invention having multiple earring panels hanging from a wall mounted swivel bracket.

FIG. 8 is a cross-sectional view of the swivel bracket of the invention as seen from line 8—8 in FIG. 7.

FIG. 9 is a cross-sectional view of the swivel bracket of the invention as seen from line 9—9 in FIG. 8.

FIG. 10 is a cross-sectional view of the top portion of a panel as seen from line 10—10 in FIG. 7.

DETAILED DESCRIPTION OF THE INVENTION

Figure 1:
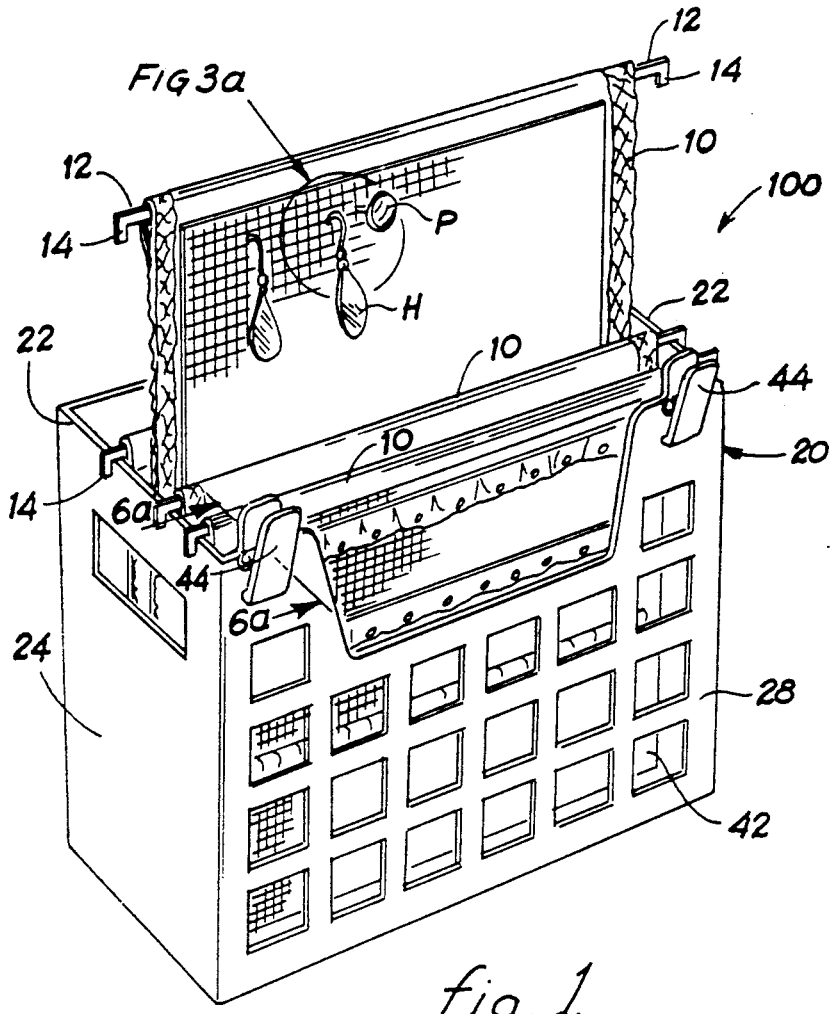
FIG. 1 is a perspective view of the preferred embodiment of the invention wherein three earring panels are shown hanging from a support rod braced over the sides of a four-sided cabinet and one panel is illustrated as partially lifted from its rest position.

This invention lies in the idea of combining multiple panels of a plastic net layer lined with a fabric backing in vertical configuration to provide a convenient and versatile article for storing and displaying jewelry, such as earrings and the like. Referring to the drawings, wherein the same numerals and symbols are used throughout to refer to the same parts in the various figures, FIG. 1 illustrates a perspective view of the earring case 100 of this invention, wherein a multiplicity of vertical panels 10 is shown hanging from the top of a four-sided cabinet 20. Each panel comprises a support rod 12 featuring a hook 14 at each end for engaging the top edge 22 of the side walls 24, so that it can be braced across the top of the cabinet 20 to hang a panel 10 therefrom. As also illustrated in the cross-sectional side view of FIG. 2 and in the enlarged partial view of FIG. 3*a*, each panel consists of a fabric sheet 16 hanging from the support rod 12 and a plastic net layer 18 attached to the top horizontal edge of the front of the fabric.

Figure 4:
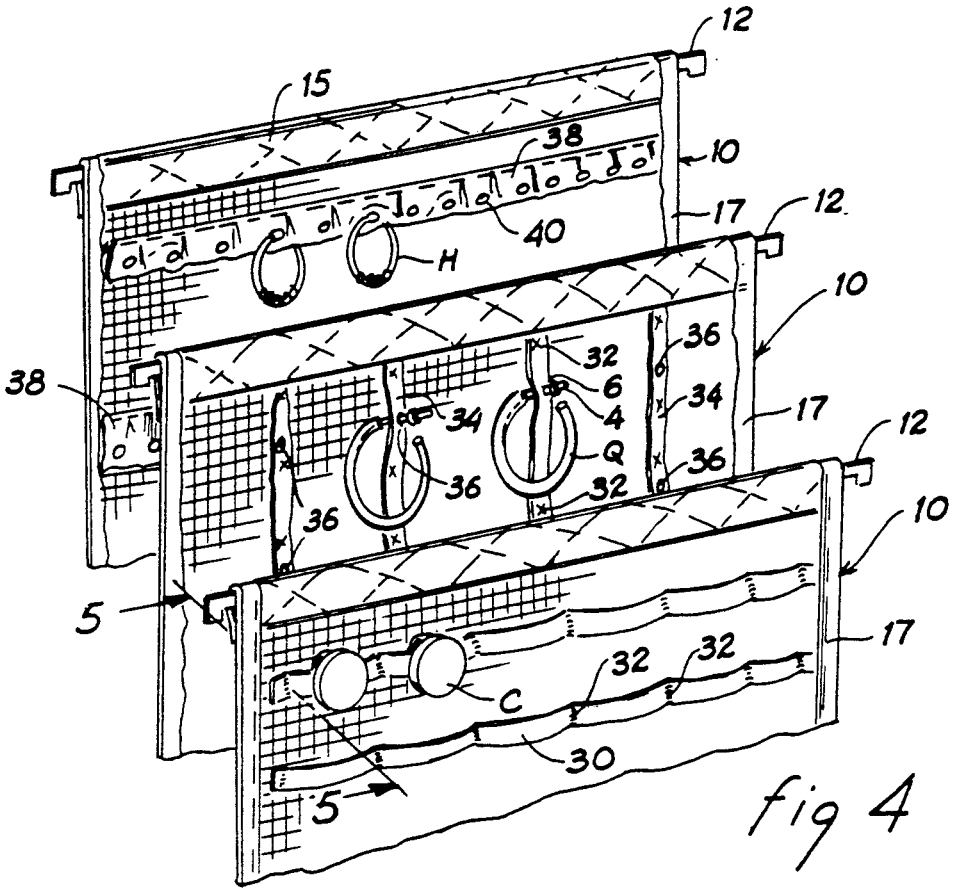
FIG. 4 is a perspective view of three panels of the invention illustrating various features for facilitating the attachment of different kinds of earrings.
Figure 3A:
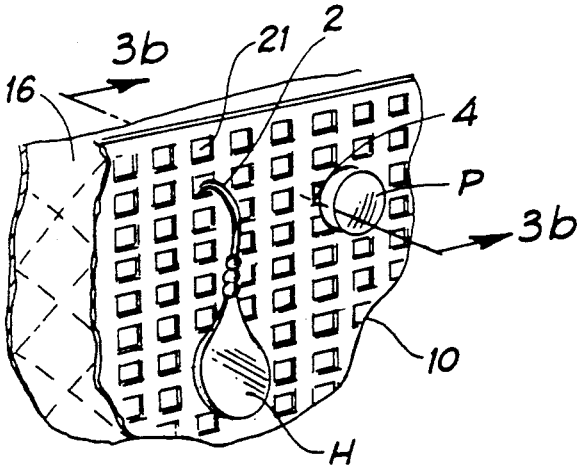
FIG. 3*a* is an enlarged perspective view of a portion of an earring panel, as shown in FIG. 1.
Figure 5:
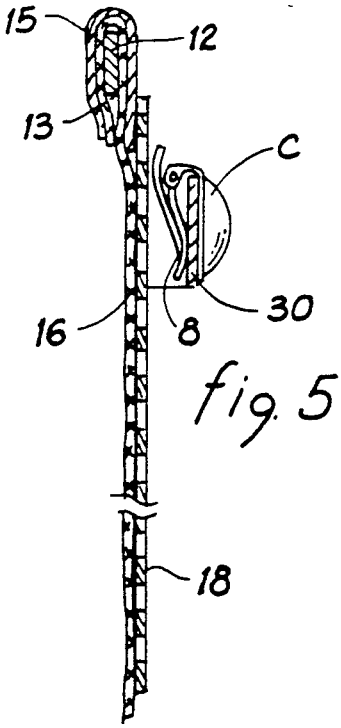
FIG. 5 is a cross-sectional view of a panel of the invention taken from line 5—5 in FIG. 4.
Figure 3B:
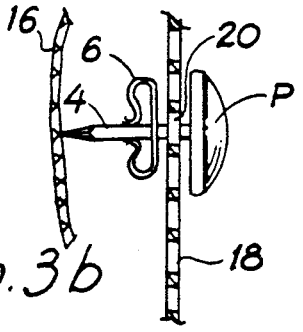
FIG. 3*b* is a cross-sectional view of a portion of an earring panel, as seen from line 3*b*–3*b* in FIG. 3*a*.

Although not critical to the invention, the fabric sheet 16 is preferably hung from the support rod 12 by folding the top edge of the fabric and stitching or gluing it to form a horizontal channel pocket 13 through which the rod is threaded. As shown in FIGS. 4 and 5, an additional layer 15 may be added over the channel 13 for reinforcement or for decorative purposes. Also, a side or end binding 17 may be provided for increased structural strength. The net layer 18 may be attached to the fabric 16 (generally conforming in shape) by stitching or otherwise fastening their edges together, so as to form a uniform flat panel having a soft, fabric back (a liner, which could be quilted) and a relatively rigid, plastic front with a large number of individual meshes 21 available for hooking earring prongs or posts through them. It is preferable to leave the fabric 16 generally loose from the net material, other than required to keep them together to form a panel, so that the earwire prong of an earring may be easily inserted through a mesh of the net and between the two layers. Thus, as illustrated in FIGS. 3*a* and 3*b*, a hook-type earring H may be attached to a panel 10 by passing its prong 2 through any mesh 21 in the net material 18 constituting the front of the panel and by hooking it to the net without also piercing the fabric sheet loosely attached to it. A post-type earring P may be fastened to a panel by inserting its post 4 through a mesh and then securing it in place by using the friction nut 6 normally used for wearing the earring.

Other features may be added to the panels in order to facilitate its use with hoop-style post earrings and also to permit the storage of clasp-type earrings, circular earrings, wire earrings, brooches, tie-pins and other jewelry. As shown in one of the three panels seen in FIG. 4, horizontal straps 30 may be fastened to the net layer 18 by means of stitches or snaps 32 spaced a few inches apart (preferably 1 to 1 and ½ inches), so that free segments of strap become available for use in hanging such clasp-type ornaments on the panel. FIG. 5 illustrates in cross-sectional view a typical clasp-type earring C attached to a panel by clipping its clasp 8 onto the strap 30. It is recommended that the straps 30 be made with material with sufficient rigidity to support clipped earrings firmly and securely. The straps 30 are illustrated in horizontal configuration, but can obviously be attached to the panel 10 vertically, or even in oblique patterns, so long as free segments are available for clipping earrings thereto.

Another feature may consist of vertical straps or ribbons 34, similarly fastened to the net layer 18 by means of stitches or snaps 32, which can be used to hang a large-hoop post-type earring Q by inserting its post 4 through the material constituting the ribbon and securing it in place with the aid of its friction nut 6, as seen in FIG. 4. These ribbons are preferably made with woven material, so that an earring post may be easily inserted through it without damaging the fabric. Alternatively, preformed holes 36 may be provided at regular intervals within the length of the ribbon for receiving the earrings in a regular pattern. The same function may be achieved by having horizontal fringes 38 with perforations 40 through which wire-type, circular and screw-on earrings may be hung. Of course, such straps, ribbons and fringes also provide ornamental value to the invention and may be used to color code panels for separating the various pieces of jewelry, as desired.

Figure 6A:
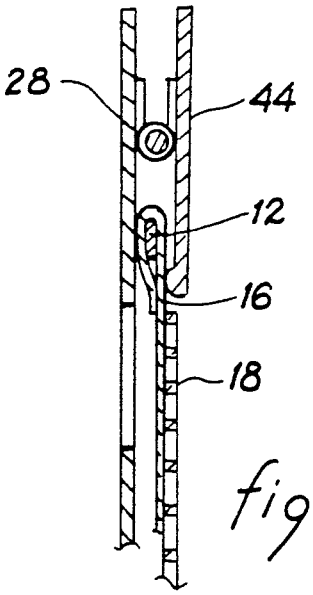
FIG. 6*a* is a cross-sectional view taken from line 6*a*–6*a* in FIG. 1 showing a clip incorporated into the front wall of the cabinet of the invention for retaining the support rod of a panel being viewed by a user.
Figure 6B:
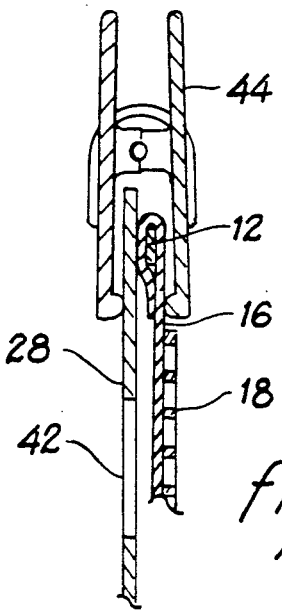
FIG. 6*b* is a cross-sectional view of a separate clamp to be used in conjunction with the front wall of the cabinet of the invention for retaining the support rod of a panel being viewed by a user.

In use, earrings and other jewelry equipped with post or clasp mounts are anchored either to the various straps, ribbons and fringes, or to the panel's mesh of the net material, and each panel is hung in the cabinet 20 by bracing its support rod 12 over the edge 22 of the side walls 24 of the cabinet. The panels are stored vertically facing the front wall 28 of the cabinet, which in the preferred embodiment of the invention features open windows 42 for viewing the jewelry hung on the front panel inside. The cabinet 20 of the invention may also comprise clips 44 (at least one, but preferably two, as seen in FIG. 1) along the outer top edge of the front wall 28 to provide a means for hanging therefrom any panel 10 that a user has extracted from the case in order to select or store some jewelry. The clips 44 may be used to pin the ends of the support rod 12 of a panel, so that the panel and the jewelry attached to it drape over the front of the cabinet while a user removes or fastens the earrings. The pins 44 may be an integral part of the front wall 28, as illustrated in the embodiment shown in cross-sectional view in FIG. 6*a*, or they may be separate components used as clamps over the front panel, as shown in FIG. 6*b*. In either case the function and method of use of the clips is the same.

Figure 2:
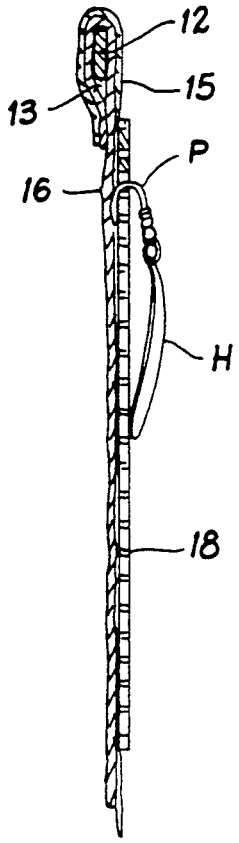
FIG. 2 is a side view of the top portion of a panel illustrating a hook earring hanging from the mesh of the plastic net of a panel.

The material constituting the several components of the panels 10 must have the characteristics necessary for durability and functional operability. The mesh material of the net 18 should be sufficiently stiff to give a panel its structural shape and to provide support to the earrings hung through its mesh. The fabric backing 16 may be made of different types of weave. Preferably, it should be thick or even padded (as illustrated in FIGS. 2 and 3*a*) for protecting the face of the jewelry in the panel behind. The two layers of fabric and net material can be stitched together, glued, stapled or otherwise connected in ways that would be obvious to those skilled in the art, so long as the functional features described above are retained. The support rods and the cabinet require no particular features, but obviously need to be compatible in size and shape in order to permit the hanging of the rods from the top of the cabinet. Handles 46 may be provided to aid in transporting the case. Finally, a lid (not shown in the drawings) may be provided for protection of the panels stored in the cabinet 20.

In another embodiment 200 of the invention seen in FIGS. 7–10, the same concept of providing multiple vertical panels for earring storage is implemented by hanging the panels 10 from a wall mounted bracket 50. As illustrated in the cross-sectional view of FIG. 8, the bracket 50 is a conventional swivel device comprising support rods 52 that extend radially from a pivot structure 54 fastened to a vertical surface W, such as a wall or door, by means of screws 56 or other equivalent retaining apparatus. By hanging panels 10 from these rods, an open earring storage and retaining device is obtained that permits a user to sort through the various panels simply by swiveling the unwanted panels out of the way. As illustrated in FIGS. 8 and 9, the rods 52 are preferably shaped with a progressively increasing S-shaped curvature 58 in the vicinity of the pivot end 60 (the first rod having no curvature) in order to accommodate the thickness of the panels 10 hanging from the rods, so that the panels may hang parallel to each other, rather than in radial configuration. Of course, the specific size of the curvatures 58 would vary with the kind of material used to make the panels 10, which are built with the same characteristics disclosed for the first embodiment detailed above. FIG. 10 illustrates an earring H hanging from a perforated fringe 38 along the top of a panel.

While the embodiments shown in the figures feature the specific shapes therein described, the invention can obviously take other shapes with equivalent functionality and utility. In fact, any shape for any of the components that retains the functional characteristics described above provides an acceptable apparatus to practice the invention. For example, while the panels 10 are shown herein as rectangular for optimal space utilization, any shape suitable for hanging would be acceptable. Similarly, the exact shape of the cabinet of the preferred embodiment is not critical, so long as compatible with the shape and dimensions of the panels to be hung in it.

Various changes in the details, steps and materials that have been described may be made by those skilled in the art within the principles and scope of the invention herein illustrated and defined in the appended claims. Therefore, while the present invention ha been shown and described herein in what is believed to be the most practical and preferred embodiment, it is recognized that departures can be made therefrom within the scope of the invention, which is not to be limited to the details disclosed herein but is to be accorded the full scope of the claims so as to embrace any and all equivalent apparatus and methods.

I claim:

1. An apparatus for storing and displaying jewelry comprising, in combination:

(a) a multiplicity of panels, each consisting of a fabric sheet lining a generally conforming net layer of rigid material to form a support structure for jewelry attached thereto, whereby articles of jewelry may be hung on the mesh of said net and protected by said fabric sheet;

(b) a swivel bracket consisting of a conventional pivot structure fastened to a vertical surface and having a plurality of support rods that extend radially therefrom;

wherein the fabric sheet in each of said multiplicity of panels has a top edge folded to form a horizontal channel pocket through which a support rod is threaded to provide support to said multiplicity of panels;

whereby each panel may be accessed by a user for viewing and retrieving stored jewelry at will.

2. An apparatus for storing and displaying jewelry comprising, in combination:

(a) a multiplicity of panels, each consisting of a fabric sheet lining a generally conforming net layer of rigid material to form a support structure for jewelry attached thereto, whereby articles of jewelry may be hung on the mesh of said net and protected by said fabric sheet;

(b) means for supporting said multiplicity of panels in vertical position, whereby each panel may be accessed by a user for viewing and retrieving stored jewelry at will; and (c) a cabinet having a front wall and parallel side walls, and comprising a multiplicity of retaining rods braced horizontally over said side walls; wherein the fabric sheet in each of said multiplicity of panels has a top edge folded to form a horizontal channel pocket through which a retaining rod is threaded to provide support for said multiplicity of panels.

3. The apparatus recited in claim 2, further comprising horizontal straps attached to said net layer of a panel to form free strap segments available for hanging clip-on type jewelry on the panel.

4. The apparatus recited in claim 3, wherein said free segments of strap available for hanging clip-on type jewelry are 1 to 1 and ½ inches long.

5. The apparatus recited in claim 2, further comprising vertical ribbons attached to said net layer of a panel for use in hanging post-type jewelry on the panel.

6. The apparatus recited in claim 5, further comprising preformed holes at regular intervals within the length of said ribbons for hanging post-type jewelry in regular patterns.

7. The apparatus recited in claim 2, further comprising horizontal fringes attached to said panels with perforations available for hanging jewelry.

8. The apparatus recited in claim 2, wherein said front wall of the cabinet comprises open windows for viewing the jewelry hung on the front panel contained inside the cabinet.

9. The apparatus recited in claim 2, further comprising at least one clip along the outer top edge of said front wall of the cabinet to provide a means for hanging a panel that a user has extracted from the cabinet for viewing and selecting or storing articles of jewelry.

10. The apparatus recited in claim 9, wherein said at least one pin is an integral part of the front wall of said cabinet.

11. The apparatus recited in claim 2, further comprising handles in said side walls of the cabinet to aid in transporting the apparatus.

12. The apparatus recited in claim 1, wherein said support rods feature an S-shaped curvature in order to accommodate the thickness of said panels hanging therefrom,, so that the panels may hang parallel to each other.

13. The apparatus recited in claim 1, further comprising horizontal straps attached to said net layer of a panel to form free strap segments available for hanging clip-on type jewelry on the panel.

14. The apparatus recited in claim 13, wherein said free segments of strap available for hanging clip-on type jewelry are 1 to 1 and ½ inches long.

15. The apparatus recited in claim 1, further comprising vertical ribbons attached to said net layer of a panel for use in hanging post-type jewelry on the panel.

16. The apparatus recited in claim 15, further comprising preformed holes at regular intervals within the length of said ribbons for hanging post-type jewelry in regular patterns.

17. The apparatus recited in claim 1, further comprising horizontal fringes attached to said panels with perforations available for hanging jewelry.

18. A method of storing and displaying jewelry, comprising the following steps:

(a) providing a multiplicity of panels, each consisting of a fabric sheet lining a generally conforming net layer of rigid material to form a jewelry support structure;

(b) providing a cabinet having a front wall and parallel side walls, and a multiplicity of retaining rods braced horizontally over said side walls; wherein the fabric sheet in each of said multiplicity of panels has a top edge folded to form a horizontal channel pocket through which a retaining rod is threaded to provide support for said multiplicity of panels; and (c) attaching articles of jewelry to said multiplicity of panels by hanging them on the mesh of said net and protecting them with said fabric sheet;

whereby each panel may be accessed by a user for viewing and retrieving stored jewelry at will.

* * * * *